US010337847B2

(12) United States Patent
Thornhill

(10) Patent No.: US 10,337,847 B2
(45) Date of Patent: Jul. 2, 2019

(54) CHEMICAL ORDNANCE CONTAINMENT AND TRANSPORT BAG

(71) Applicant: Integrated Textile Solutions, Inc., Salem, VA (US)

(72) Inventor: David Thornhill, Salem, VA (US)

( * ) Notice: Subject to any disclaimer, the term of this patent is extended or adjusted under 35 U.S.C. 154(b) by 0 days.

(21) Appl. No.: 14/872,565

(22) Filed: Oct. 1, 2015

(65) Prior Publication Data

US 2017/0097218 A1 Apr. 6, 2017

(51) Int. Cl.

| | |
|---|---|
| ***F42B 39/14*** | (2006.01) |
| ***B65D 33/06*** | (2006.01) |
| ***B65D 33/25*** | (2006.01) |
| ***B65D 30/08*** | (2006.01) |
| *B65D 81/26* | (2006.01) |

(52) U.S. Cl.

CPC ..... *F42B 39/14* (2013.01); *B65D 31/02* (2013.01); *B65D 33/06* (2013.01); *B65D 33/25* (2013.01); *B65D 81/266* (2013.01)

(58) Field of Classification Search

CPC ..... F42B 39/14; B65B 7/02; B65D 31/02; B65D 33/06; B65D 33/25

USPC ..... 383/97

See application file for complete search history.

(56) References Cited

U.S. PATENT DOCUMENTS 841,620 A * 1/1907 Buchanan ..... A45C 13/20 190/27
4,261,448 A * 4/1981 Myers ..... A45C 13/26 190/115
4,378,403 A * 3/1983 Kotcharian ..... B32B 15/08 220/901
4,578,814 A * 3/1986 Skamser ..... A47J 47/145 206/545
4,919,240 A * 4/1990 Tobias ..... A45F 3/02 150/108
5,149,203 A * 9/1992 Sacks ..... A45C 3/00 190/125
5,538,169 A * 7/1996 Moore ..... A45C 15/00 190/109

(Continued)

OTHER PUBLICATIONS

ADS, Inc., YouTube Video, "ADS & UTS SCOTS Solution | Specialized Chemical Ordnance Transportation", https://www.youtube.com/watch?v=K017G5zI0E4 (Jul. 16, 2014), 6 pages.

*Primary Examiner* — Peter N Helvey
(74) *Attorney, Agent, or Firm* — New River Valley IP Law, P.C.; Michele L. Mayberry; Timothy D. Nolan

(57) ABSTRACT

A chemical ordnance containment and transport bag is described. The bag may comprise a flexible body, an end portion, a zipper bisecting the flexible body along two longitudinal sides and a lateral side and terminating at the end portion, and a plurality of straps which extend widthwise across the flexible body from each longitudinal portion of the zipper. The flexible body may comprise one or more layers of activated carbon cloth comprising at least one layer of knitted activated carbon cloth and at least one layer of woven activated carbon cloth. Embodiments may also include a method of securing chemical ordnance, comprising providing a chemical ordnance containment and transport bag, placing a chemical ordnance item inside the bag, and closing the zipper and adjusting the straps to secure the chemical ordnance item inside the bag.

17 Claims, 6 Drawing Sheets

(56) References Cited

U.S. PATENT DOCUMENTS 5,660,476 A * 8/1997 DeCoster ..... A45C 11/20 190/108
5,894,780 A * 4/1999 Taniguchi ..... C05F 17/0205 383/117
6,243,892 B1 * 6/2001 Kelling ..... A47G 9/086 224/153
6,244,482 B1 * 6/2001 Gyarmaty ..... B60R 9/055 224/318
6,257,470 B1 * 7/2001 Schaefer ..... B60R 9/055 224/318
6,892,912 B1 * 5/2005 MacNeil ..... B60R 9/055 224/318
6,902,087 B2 * 6/2005 Hancock ..... B62J 9/00 190/902
7,188,714 B1 * 3/2007 Herold ..... A63B 55/60 190/115
7,494,629 B2 2/2009 Kaiser
7,496,995 B2 3/2009 Rosario et al.
8,183,426 B2 5/2012 Cole et al.
8,186,505 B1 5/2012 Saucedo
8,840,306 B1 9/2014 Poel et al.
2004/0134923 A1 7/2004 Aquino et al.
2008/0260301 A1 * 10/2008 Winter ..... B63B 35/7946 383/40
2009/0080811 A1 3/2009 Stefanek et al.
2010/0316310 A1 12/2010 Heater et al.
2012/0024850 A1 * 2/2012 Mazzan ..... A45C 13/06 220/200
2012/0106872 A1 5/2012 Blanchard et al.
2012/0301057 A1 11/2012 Conant et al.
2013/0048686 A1 * 2/2013 McDonald ..... A45F 4/06 224/191
2015/0352392 A1 * 12/2015 Kaiser ..... A62D 5/00 502/2

* cited by examiner

CHEMICAL ORDNANCE CONTAINMENT AND TRANSPORT BAG

BACKGROUND OF THE INVENTION

Field of the Invention

The present invention is in the field of chemical ordnance containment and transport. More particularly, embodiments of the present invention provide a chemical ordnance sealing, containing, and transport bag to facilitate the transport of the chemical ordnance in a safe and hygienic manner which reduces or prevents exposures of personnel to chemical agents.

Description of Related Art

Explosive Ordnance Disposal (EOD) Operators and first responders face many challenges during leak seal, pack, and transport missions involving unexploded chemical ordnance. In particular, chemical weapons create special concerns for exposure of these personnel to toxins such as Sarin, VX, Mustard Agent, hydrogen cyanide, and the like. While there have been some efforts to provide for the containment and transportation of hazardous ordnance including those described, for example, in U.S. Pat. No. 8,186,505 and US Patent Application Publication No. 2009/0080811, there is still a need in the art for an effective solution to this problem.

SUMMARY OF THE INVENTION

Embodiments of the invention provide a chemical ordnance containment and transport bag. The bag of the invention is adapted for sealing and containing chemical ordnance and providing for its safe transport while preventing or minimizing exposure of EOD personnel to toxic chemicals that may leach or volatilize from the ordnance. In one embodiment of the invention, the inventive bag comprises a flexible body, an end portion, a zipper bisecting the flexible body along two longitudinal sides and a lateral side and terminating at the end portion, and a plurality of straps which extend widthwise across the flexible body from each longitudinal portion of the zipper. The flexible body may comprise one or more layers of activated carbon cloth comprising at least one layer of knitted activated carbon cloth and at least one layer of woven activated carbon cloth. Embodiments may also include a method of securing chemical ordnance, comprising providing a chemical ordnance containment and transport bag of the invention, placing a chemical ordnance item inside the bag, and closing the zipper (or other closure) and adjusting the straps to secure the chemical ordnance inside the bag.

BRIEF DESCRIPTION OF THE DRAWINGS

The accompanying drawings illustrate certain aspects of embodiments of the present invention, and should not be used to limit the invention. Together with the written description the drawings serve to explain certain principles of the invention.

DETAILED DESCRIPTION OF VARIOUS EMBODIMENTS OF THE INVENTION

Figure 1:
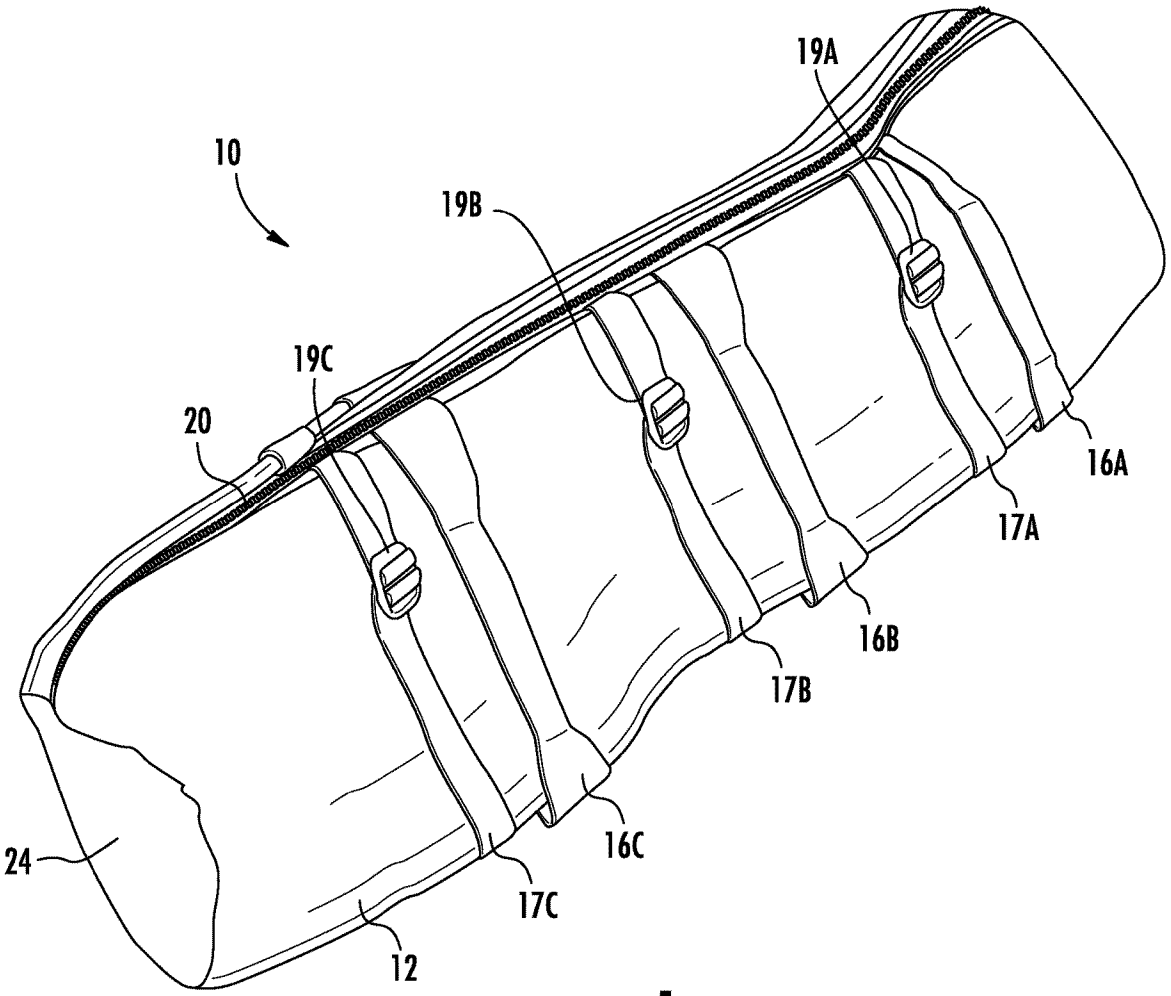
FIG. 1 is a drawing showing a top perspective view of a chemical ordnance containment and transport bag according to an embodiment of the invention.

Reference will now be made in detail to various exemplary embodiments of the invention. It is to be understood that the following discussion of exemplary embodiments is not intended as a limitation on the invention. Rather, the following discussion is provided to give the reader a more detailed understanding of certain aspects and features of the invention.

Embodiments of the invention provide for an ordnance containment bag particularly suitable for sealing, containing, and transporting chemical ordnance. In embodiments, the inventive bag comprises a flexible body with one or more zippers or other closures for opening or sealing the bag and one or more straps for securing an ordnance item inside the bag or serving as handles for transporting the bag. The flexible body of the inventive bag may be constructed from several layers of material, including one or more layers of activated carbon fabric for absorbing contaminants released from the ordnance item. In embodiments, the bag is dimensioned to accommodate one or more ordnance items such as undetonated shells, bombs, and similar projectiles such that the length of the bag is several times longer than the width when the bag is closed.

In one embodiment, the ordnance containment bag comprises a single zipper that wraps around three sides of the bag (leaving a width of the bag without a zipper) and several straps that run laterally from zipper to zipper along the width of the bag on opposite sides. However, in other embodiments, the straps may run circumferentially around the width bag or longitudinally along the length of the bag or diagonally or any combination of these. The straps may include anywhere from 1 to 10 non-adjustable straps (such as 1, 2, 3, 4, 5, 6, 7, 8, 9, or 10) which serve as handles and from 1 to 10 adjustable straps (such as 1, 2, 3, 4, 5, 6, 7, 8, 9, or 10) which serve to secure the ordnance inside the bag, and the non-adjustable and adjustable straps may alternate. Further, other embodiments may include multiple zippers for opening or closing the bag, or for opening or closing only a portion or portions of the bag, such as two zippers running along the longitudinal sides of the bag. A width of the bag without a zipper may comprise a layer of vinyl fabric and may serve as the end or bottom of the bag.

The flexible body of the ordnance containment bag may be constructed of several layers of material. In one embodiment, the flexible body may comprise an outer layer of non-permeable chemical resistant fabric such as TYCHEM®, one or more middle layers of woven activated carbon fabric, and an inner layer comprising a laminate comprising a layer of knitted activated carbon fabric and a layer of polymeric material such as nylon, rayon, or polyester. However, other embodiments may eliminate one or more of these layers, or include additional layers of material. For example, some embodiments may include three, four, five, or more layers of woven activated carbon fabric, or two, three, four, or more layers of knitted activated carbon fabric. In embodiments, some or all of the activated carbon fabric layers may alternate between woven and knitted layers.

The one or more layers of activated carbon fabric may absorb one or more contaminants released from or associated with an ordnance item inside the bag. The activated carbon fabric is particularly useful for absorbing contaminants in the gaseous or vapor phase that volatilize or leach from the ordnance.

Figure 2:
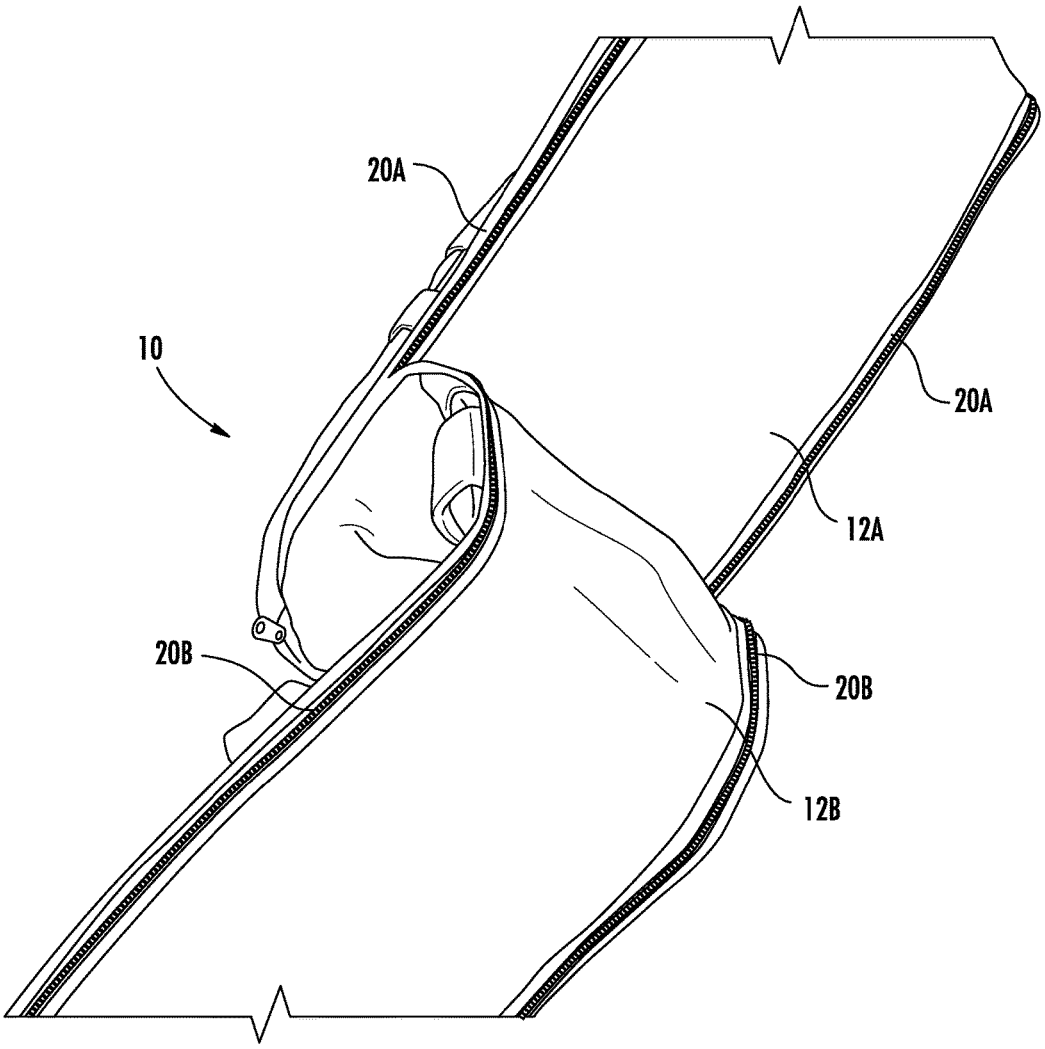
FIG. 2 is a drawing showing a top perspective view of an opened chemical ordnance containment and transport bag according to an embodiment of the invention.
Figure 3:
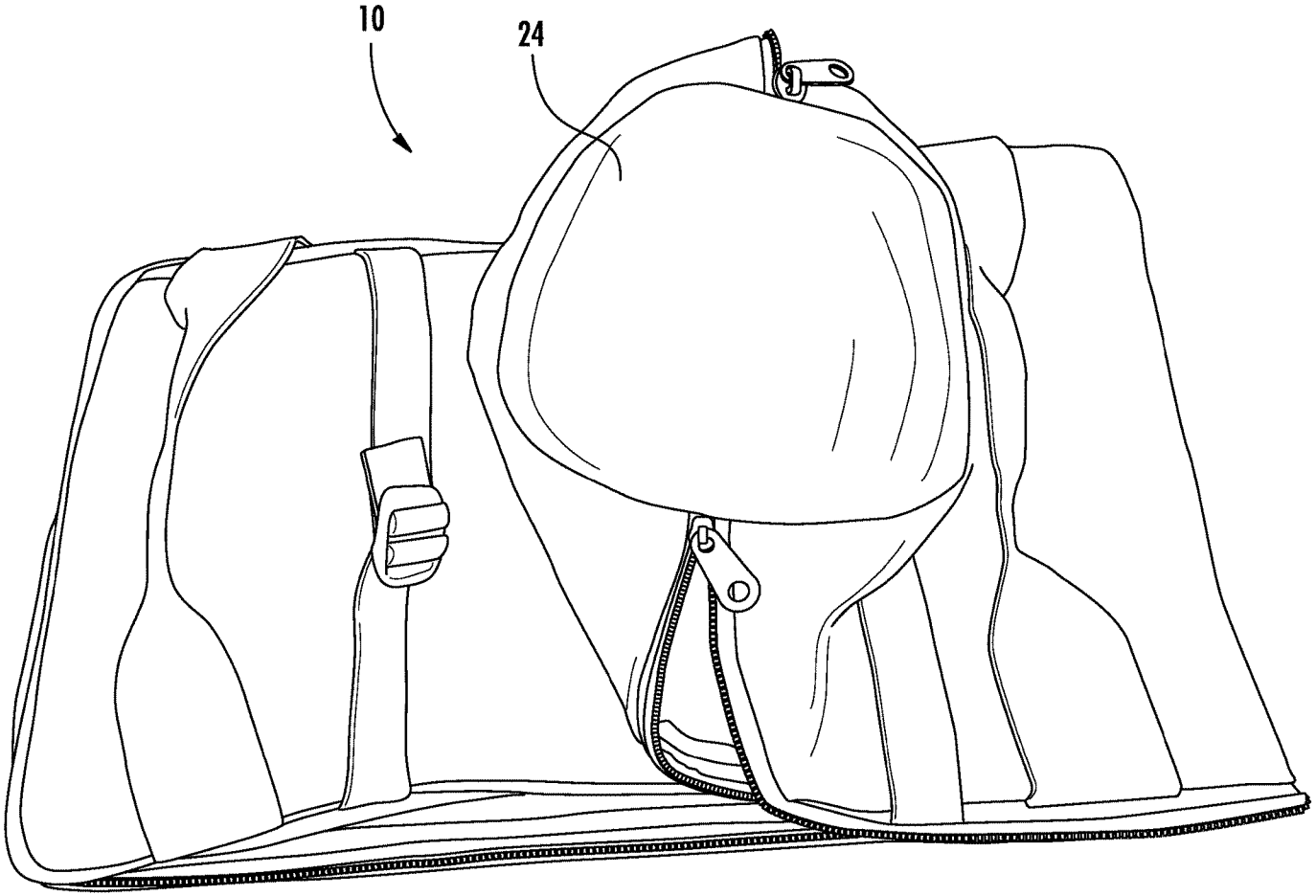
FIG. 3 is a drawing showing a top perspective view of the bottom or end portion of a chemical ordnance containment and transport bag according to an embodiment of the invention.

Turning now to the figures, FIGS. 1-3 show an embodiment of a chemical ordnance containment and transport bag 10 according to the invention. Shown in FIG. 1 is flexible body 12, the outer layer of which may contain a non-permeable chemical resistant fabric such as TYVEK® or TYCHEM®, which provides a layer of protection for personnel handling the bag such that exposure to contaminants is minimized. Also visible in FIG. 1 and in FIG. 3 is bottom 24 of the bag which in some embodiments comprises a layer of vinyl fabric. Bottom 24 of the bag can comprise only a layer of vinyl fabric, or the vinyl fabric can be disposed as an exterior layer of material combined with other layers of material(s) used for the body portion of the bag. The layer of vinyl can be sewn on top of or bonded to the top of the other layers of fabric(s) of the flexible body 12. In embodiments, the flexible body 12 may be joined to the bottom 24 of the bag at one or more seams such that the bottom 24 represents a separate portion of vinyl not disposed on the other layers. Additional structural features include zipper 20 extending along three sides of the bag 10 and plurality of straps 16A-16C and 17A-17C extending from zipper to zipper along the width of the bag. In one embodiment, the plurality of straps is provided in pairs, with one strap in each pair being non-adjustable 16A-16C and the other adjustable 17A-17C. In FIG. 1 each of the adjustable straps 17A-17C may comprise two individual straps joined together at a buckle such as that shown by 19A-19C for securing the contents inside the bag 10, while non-adjustable straps 16A-16C may be of unitary construction and be configured to serve as handles. In embodiments, the dimensions of the non-adjustable straps 16A-16C may be 8 to 20 inches long by 0.5 to 1 inches wide, while adjustable straps 17A-17C may provide for greater length and be somewhat thinner in width. FIG. 2 shows the bag 10 unzipped, which reveals that the flexible body 10 is divided into a first 12A portion which includes first 20A half of zipper and a second portion 12B which includes second half of zipper 20B; thus, bag 10 is closed or sealed by aligning first 12A and second 12B portions, closing or folding the two halves 20A and 20B one on top of the other, then zippering the two halves of the bag together to provide the bag in a closed or sealed position. FIG. 3 shows that the two sides of the bag are joined together on a side where the zipper terminates that is configured as a flat circular portion that represents the bottom 24 of the bag, which in this embodiment comprises a layer of vinyl fabric (such as BONDCOTE™ vinyl (BondCote Corporation, Pulaski, Va.)) on top of the outer layers of the flexible body for increased strength and durability. Thus, in this embodiment the bottom 24 of the bag is an extension of the flexible body 12 that comprises an additional layer of material; in other embodiments the bottom 24 of the bag may be comprised of an entirely different material than the flexible body such that the flexible body 12 is joined to the bottom 24 at an additional seam. Not shown are inner layers of material of flexible body that are useful for absorbing contaminants released from the ordnance; these will be shown in FIG. 6.

The ordnance containment bag may be provided in any suitable dimensions for containing munitions. The types of military ordnance that the containment bag may contain are beyond the scope of this specification as there as thousands of types of ordnance that exist. The bag can be sized and shaped appropriately for any munition, chemical ordnance, shells and other chemical rounds. In embodiments, the dimensions of the flexible body 12 of the bag 10 may be 30 to 50 inches long by 10 to 20 inches wide by 6 to 12 inches deep when assembled. In a specific embodiment, the bag is 35 inches long by 12 inches wide by 7 inches deep. However, in other embodiments, the dimensions may deviate from this by plus or minus 10%, 20%, 30%, 40%, 50%, or more. In a particular embodiment, the chemical ordnance bag is dimensioned to contain a standard 155 mm artillery shell such as those fired from howitzers and similar weapons. The bag 10 may be provided in somewhat larger dimensions than the 155 mm artillery shell to provide for extra room or accommodate even larger shells; the adjustable straps may then be used to tighten around the ordnance inside the bag, thereby securing it inside the bag.

Figure 4A:
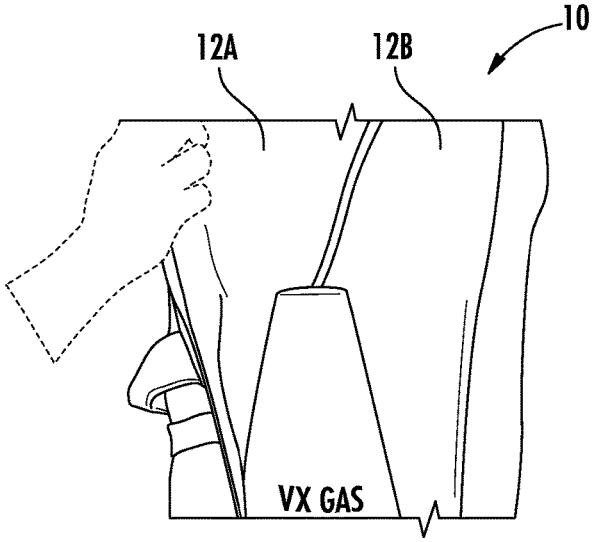
FIGS. 4A-4D are drawings showing a side perspective view of a chemical ordnance containment and transport bag during use according to an embodiment of the invention.
Figure 4B:
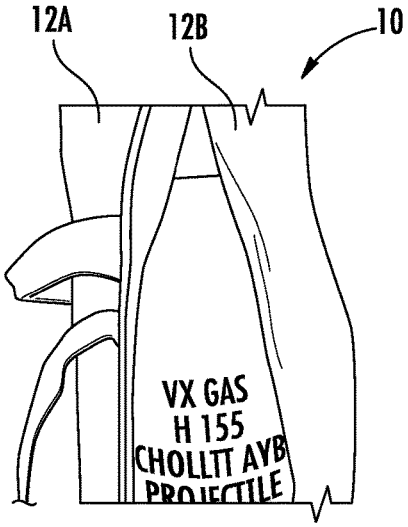
Figure 4C:
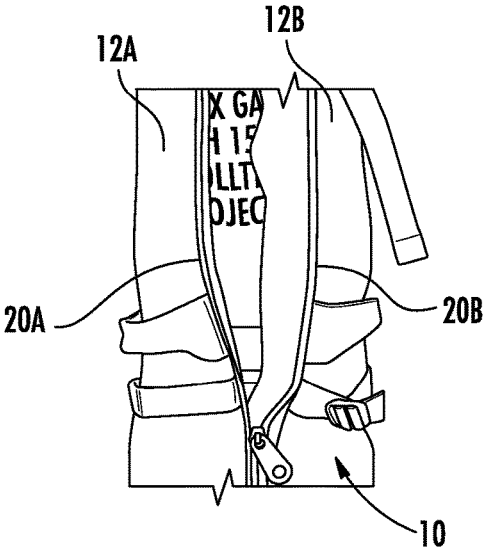
Figure 4D:
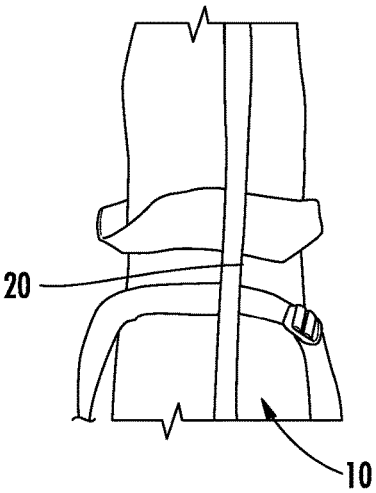
Figure 5:
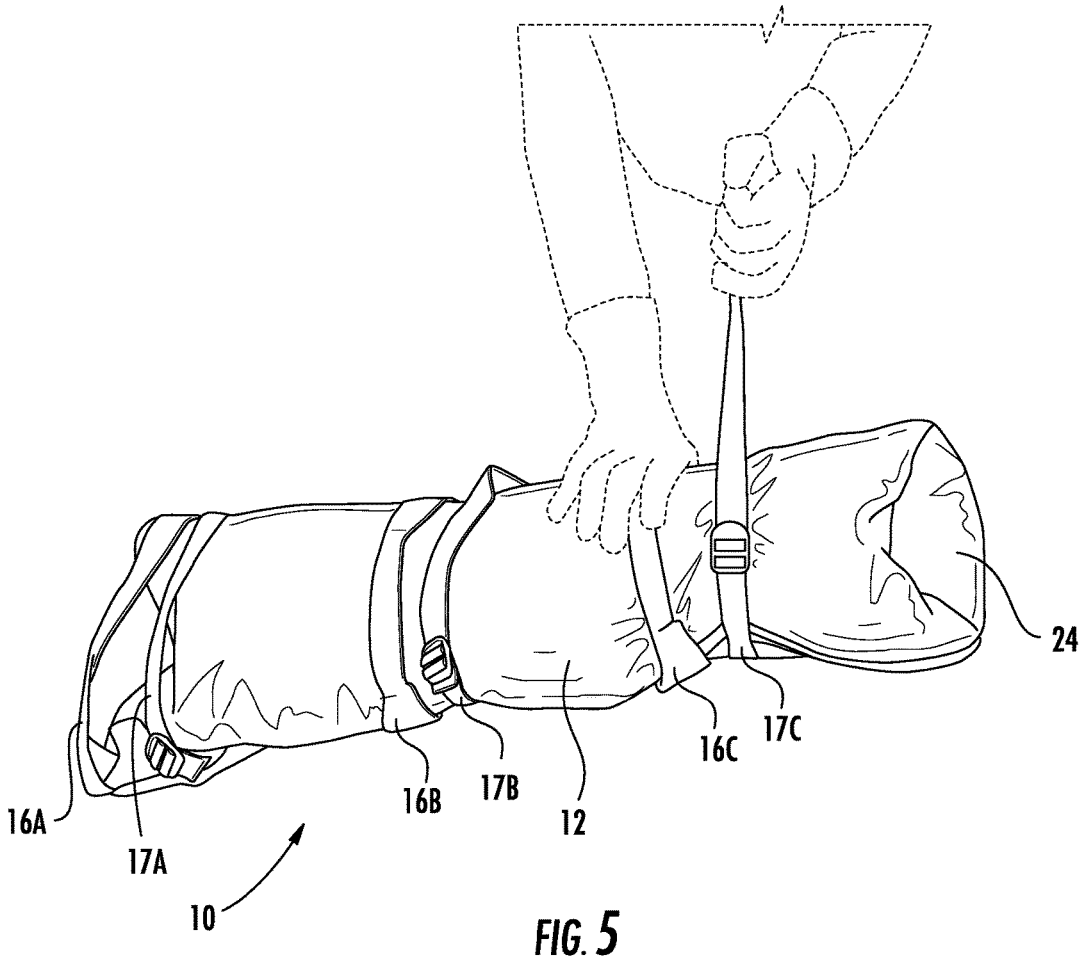
FIG. 5 is a drawing showing a side perspective view of a chemical ordnance containment and transport bag during use according to an embodiment of the invention.

FIGS. 4A-4D and FIG. 5 demonstrate how the bag may be used to contain chemical ordnance. In this example, the bag is first placed upright so that the end portion or bottom of the bag sits on a flat surface such as the ground. Then, a 155 mm shell is placed so that it sits upright on the bottom of the bag. FIGS. 4A and 4B show that the two sides 12A and 12B of the flexible body are brought together to enclose the shell, and then are subsequently aligned and zippered together by joining each half 20A and 20B of the zipper 20 as shown in FIGS. 4C and 4D. FIG. 5 shows that once the shell is inside the bag 10, the bag is laid lengthwise on the ground and the shell is secured with the adjustable straps 16A-16C. After being secured, the bag 10 may be carried with the non-adjustable straps or handles 17A-17C.

Figure 6:
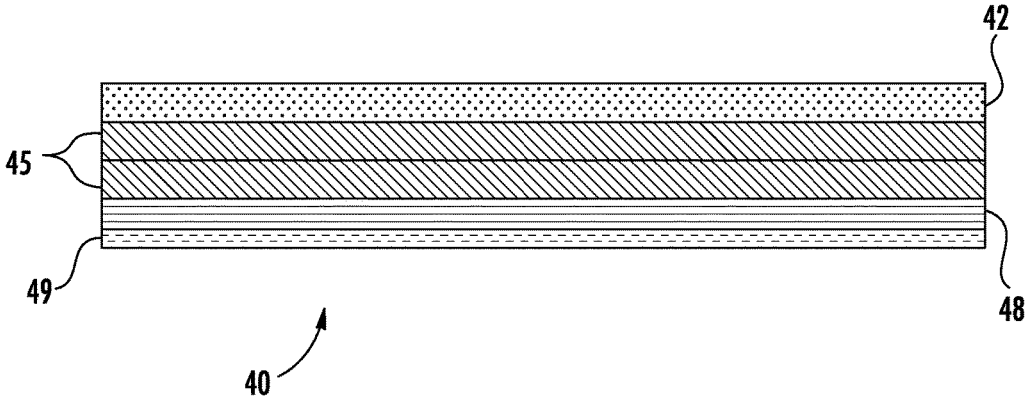
FIG. 6 is a schematic diagram showing a cross section of the layers of the flexible body of the chemical ordnance containment and transport bag according to an embodiment of the invention.

FIG. 6 shows a particular embodiment of a cross section 40 of the layers of fabric that make up the flexible body. Shown are in the figure are an outer layer of non-permeable chemical resistant fabric 42, followed by two layers of woven activated carbon fabric 45, followed by a laminate made up of a layer of knitted activated carbon 48 and a layer of polymeric material 49. The outer layer of non-permeable chemical resistant fabric 42 may be brightly colored such as in white, fluorescent, or dayglow colors to facilitate visualization by EOD personnel. Further, other embodiments may include one or more additional layers of material, such as an additional layer of non-permeable chemical resistant fabric on the outside of the bag, or one or more additional layers of woven or knitted activated carbon fabric arranged in any pattern of layers. Further, other embodiments may eliminate one or more of the layers shown in FIG. 6. The layers of fabric may be attached together around the outer perimeter of the bag, such as near the zipper as shown in FIG. 2, by conventional means such as sewing, stapling, knitting, or through an adhesive. Thus, most layers of the flexible body will fit loosely on top of each other inside the perimeter, except for the laminate which is bonded together as a single sheet. Any one or more of the layers can also be bonded or sewn together if desired for certain applications. If desired, a layer of vinyl material can be disposed on any portion of the bag, such as the bottom. In a specific embodiment, the bottom of the bag has all layers of material shown in FIG. 6 in addition to the layer of vinyl material, which may be disposed on top of the outer layer of non-permeable chemical resistant fabric 42 as an exterior-most facing layer of the bag bottom. However, in other embodiments, the layer of vinyl material is disposed between or underneath any of the layers shown in FIG. 6.

In one embodiment, the non-permeable chemical resistant fabric 42 may be made of TYCHEM® (E. I. du Pont de Nemours and Company, Wilmington, Del.) such as TYCHEM® SL, which utilizes SARANEX™ 23-P film laminated to TYVEK® fabric, resulting in a strong material that resists many chemicals. SARANEX™ barrier films (The Dow Chemical Company, Midland, Mich.) are multilayered plastic films containing an inner layer made from SARAN™ resin, which offers excellent barrier properties, and outer layers made from polyolefin resins. SARAN™ is the trade name for a number of polymers made from vinylidene chloride (especially polyvinylidene chloride or PVDC), along with other monomers. TYVEK is a nonwoven product consisting of spunbond olefin fiber. Thus, TYCHEM® can be described generically as a multilayered laminate comprising polyvinylidene chloride film, polyolefin resins, and spunbound olefin fiber.

Other embodiments may use other available brands of TYCHEM® including TYCHEM® BR, TYCHEM® CPF 3, TYCHEM® F, TYCHEM® LV, TYCHEM® QC, TYCHEM® Reflector®, TYCHEM® Responder® CSM, TYCHEM® ThermoPro, TYCHEM® TK. However, in some embodiments, TYVEK® (E. I. du Pont de Nemours and Company, Wilmington, Del.) fabric may be substituted such as TYVEK®10, TYVEK®14, and TYVEK® 16. In other embodiments, other chemical resistant fabric may be used such as ZYTRON® (Kappler, Inc., Guntersville, Ala.) or KLEENGUARD (Kimberly-Clark Corporation, Lexington, N.C.). Other embodiments may use other available chemical resistant fabrics which provide similar degrees of protection against chemical exposure.

The woven activated carbon fabric 45 may be an activated carbon cloth such as ZORFLEX® FM100/250 (Chemviron Carbon, Rainton Bridge Ind Est, Houghton le Spring DH4 5PP, United Kingdom). Similarly, the knitted activated carbon fabric may contain an activated carbon cloth such as ZORFLEX® FM50K/250 (Chemviron Carbon, Rainton Bridge Ind Est, Houghton le Spring DH4 5PP, United Kingdom). ZORFLEX® brands of carbon fabric comprise 100% activated carbon in a microporous structure. ZORFLEX® FM100/250 has a surface density of 180-220 g/m$^2$, while ZORFLEX® FM50K/250 has surface density of 130-160 g/m$^2$. The knitted activated carbon fabric 48 may be provided in a laminate with a layer of polymeric material 49 such as nylon or other synthetic material such as rayon or polyester. However, other embodiments may use other types of activated carbon fabric, including C-TEX (MAST Carbon International Limited, Jays Close, Viables, Basingstoke, Hants. RG22 4BA, United Kingdom). Other embodiments may use other available types of woven and knitted activated carbon fabric which have similar properties. In some embodiments, the activated carbon fabric may contain anywhere from 50% to 100% activated carbon, including 90% to 99%, 80% to 95%, 75% to 90%, 70% to 85%, 60% to 80%, and the like.

The inventive bag may be used for the safe removal, containment, and transport of chemical ordnance at ammunition depots, military bases, theaters of war, and the like.

The present invention has been described with reference to particular embodiments having various features. In light of the disclosure provided above, it will be apparent to those skilled in the art that various modifications and variations can be made in the practice of the present invention without departing from the scope or spirit of the invention. One skilled in the art will recognize that the disclosed features may be used singularly, in any combination, or omitted based on the requirements and specifications of a given application or design. When an embodiment refers to "comprising" certain features, it is to be understood that the embodiments can alternatively "consist of" or "consist essentially of" any one or more of the features. Other embodiments of the invention will be apparent to those skilled in the art from consideration of the specification and practice of the invention.

It is noted in particular that where a range of values is provided in this specification, each value between the upper and lower limits of that range is also specifically disclosed. The upper and lower limits of these smaller ranges may independently be included or excluded in the range as well. The singular forms "a," "an," and "the" include plural referents unless the context clearly dictates otherwise. It is intended that the specification and examples be considered as exemplary in nature and that variations that do not depart from the essence of the invention fall within the scope of the invention. Further, all of the references cited in this disclosure are each individually incorporated by reference herein in their entireties and as such are intended to provide an efficient way of supplementing the enabling disclosure of this invention as well as provide background detailing the level of ordinary skill in the art.

The invention claimed is:

1. A chemical ordnance containment and transport bag comprising:

a flexible body having an end portion that opposes an opening of the flexible body;

one or more zippers bisecting the flexible body along two longitudinal sides and a lateral side and terminating at the end portion opposite the opening; and a plurality of straps, each strap extending widthwise across the flexible body from a longitudinal portion of the zipper;

wherein, with the zipper closed and the flexible body fully extended lengthwise, the longitudinal portion of the zipper runs lengthwise along the flexible body and perpendicular to a plane on which the end portion rests;

wherein the flexible body comprises at least one layer of knitted activated carbon cloth and at least one layer of woven activated carbon cloth;

wherein the flexible body comprises:

an outer layer comprising a nonpermeable chemical resistant material;

one or more middle layers comprising woven activated carbon cloth; and an inner laminate layer comprising a laminate of knitted activated carbon cloth and a polymeric material, wherein the polymeric material represents an innermost layer of the ordnance containment bag;

wherein the outer layer, one or more middle layers, and inner laminate are sewn together along a perimeter of the flexible body.

2. The bag of claim 1, wherein the plurality of straps alternate between one or more adjustable securing straps and one or more non-adjustable handles.

3. The bag of claim 2, wherein the one or more adjustable securing straps comprise a strap adjuster or buckle.

4. The bag of claim 1, wherein the plurality of straps extend widthwise across the flexible body from a longitudinal portion of the zipper across opposite sides of the bag.

5. The bag of claim 1, wherein the flexible body is dimensioned to accommodate a 155 mm artillery shell.

6. The bag of claim 1, wherein the end portion comprises an outer layer of vinyl fabric.

7. The bag of claim 1, wherein the flexible body is divided into two zippered portions which meet at the end portion.

8. The bag of claim 1, wherein the nonpermeable chemical resistant material comprises a multilayered laminate comprising polyvinylidene chloride film, polyolefin resins, and olefin fiber.

9. The bag of claim 1, wherein the woven activated carbon cloth comprises 100% activated carbon in a microporous structure having a surface density of 180-220 g/m$^2$.

10. The bag of claim 1, wherein the knitted activated carbon cloth comprises 100% activated carbon in a microporous structure having a surface density of 130-160 g/m$^2$.

11. The bag of claim 1, wherein the layer of polymeric material is nylon.

12. A chemical ordnance containment and transport bag comprising:

a flexible body having a first, second, and third portion, wherein the first and second portions comprise complementary halves of one or more zippers surrounding a portion of a perimeter of each of the first and second portions, such that the first and second portions are capable of being joined together when the zipper is closed, wherein the first and second portions meet together at the third portion such that the zippers originate at the third portion, extend along longitudinal and lateral sides of the first and second portions, and terminate at the third portion to provide an enclosed volume within the flexible body, wherein the third portion comprises an additional material from that of the first and second portion; and a plurality of straps, each strap extending widthwise across the flexible body from two longitudinal portions of the zipper, wherein the straps alternate between one or more adjustable securing straps and one or more non-adjustable handles;

wherein, with the zipper closed and the flexible body fully extended lengthwise, the two longitudinal portions of the zipper run lengthwise along the flexible body and perpendicular to a plane on which the third portion rests;

wherein the flexible body comprises:

an outer layer comprising a non-permeable chemical resistant material;

one or more middle layers comprising woven activated carbon cloth; and an inner laminate layer comprising a laminate of knitted activated carbon cloth and a polymeric material, wherein the polymeric material represents an innermost layer of the ordnance containment bag;

wherein the nonpermeable chemical resistant material comprises a multilayered laminate comprising polyvinylidene chloride film, polyolefin resins, and olefin fiber; and wherein the layer of polymeric material is nylon.

13. The bag of claim 12, wherein the additional material is vinyl fabric.

14. The bag of claim 12, wherein the non-permeable chemical resistant material comprises a multilayered laminate comprising polyvinylidene chloride film, polyolefin resins, and spunbound olefin fiber.

15. The bag of claim 12, wherein the woven activated carbon cloth comprises 100% activated carbon in a microporous structure having a surface density of 180-220 g/m$^2$.

16. The bag of claim 12, wherein the knitted activated carbon cloth comprises 100% activated carbon in a microporous structure having a surface density of 130-160 g/m$^2$.

17. A chemical ordnance containment and transport bag comprising:

(i) a flexible body comprising a base and two elongated side panels;

wherein the flexible body comprises multiple layers of fabric comprising:

an outer layer comprising a non-permeable chemical resistant material;

one or more middle layers comprising woven activated carbon cloth; and an inner laminate layer comprising a laminate of knitted activated carbon cloth and a polymeric material;

(ii) an enclosable inner volume provided by the base and the two elongated side panels, the inner volume dimensioned to accommodate a 155 mm artillery shell; and (iii) one or more inner volume closures disposed in a manner to provide for closing or opening of the two side panels, wherein each side panel has a dimension which runs lengthwise along the flexible body and perpendicular to a plane in which the base rests with the two side panels closed and fully extended lengthwise;

wherein the nonpermeable chemical resistant material comprises a multilayered laminate comprising polyvinylidene chloride film, polyolefin resins, and olefin fiber;

wherein the woven activated carbon cloth comprises 100% activated carbon in a microporous structure having a surface density of 180-220 g/m$^2$;

wherein the knitted activated carbon cloth comprises 100% activated carbon in a microporous structure having a surface density of 130-160 g/m$^2$;

wherein the polymeric material is nylon; and wherein the base comprises vinyl fabric.

* * * * *